United States Patent [19]

Stafford et al.

[11] Patent Number: 4,593,710

[45] Date of Patent: Jun. 10, 1986

[54] FRAMED TENSION STRUCTURE

[75] Inventors: Robert Stafford, Newport Beach; Gregory Cook, San Diego, both of Calif.

[73] Assignee: Fabric and Structure Technology, Inc., Newport Beach, Calif.

[21] Appl. No.: 631,141

[22] Filed: Jul. 16, 1984

[51] Int. Cl.[4] ..... E04B 1/32

[52] U.S. Cl. ..... 135/102; 52/63; 52/86

[58] Field of Search ..... 135/91, 102, 106, 109, 135/112, 113, 115, 119, 104; 52/63, 86

[56] References Cited

U.S. PATENT DOCUMENTS

| | | | |
|---|---|---|---|
| 3,780,477 | 12/1973 | Sprung, Jr. | 135/119 |
| 3,973,364 | 8/1976 | Seaman | 135/97 |
| 4,036,244 | 7/1977 | Huddle | 135/97 |
| 4,065,906 | 1/1978 | Mears | 135/97 |
| 4,092,992 | 6/1978 | Huddle | 135/102 |
| 4,118,904 | 10/1978 | Sprung | 135/97 |
| 4,188,756 | 2/1980 | Ljungbo | 52/63 |
| 4,404,980 | 9/1983 | Wade | 135/97 |

*Primary Examiner*—Richard J. Johnson

*Attorney, Agent, or Firm*—Brown, Martin & Haller

[57] ABSTRACT

A portable, rapidly erected fabric covered building-type structure has a plurality of articulated arch frames which may be hoisted from the ground to extend transversely in longitudinally spaced vertical planes. Spreaders rigidly connect the arch frames. Individual rectangular fabric sections extend transversely between corresponding adjacent pairs of the arch frames to provide an interior sheltered from the outside environment. The side edges of the fabric sections are connected to the rails of removable ladder-like mechanisms carried by the frames for tensioning the sections across their widths. The ends of the fabric sections are also pulled downwardly at the sides of the building by other mechanisms for tensioning the fabric sections lengthwise.

4 Claims, 18 Drawing Figures

12
32
34
36
38
40
42
44
46
48
50
54
58
58'
60
62
64
66
68
70
72
74
76
84
5
6

FRAMED TENSION STRUCTURE

BACKGROUND OF THE INVENTION

The present invention relates to building structures, and more particularly, to building structures of the type in which fabric or other web material is stretched over a frame to provide an interior sheltered from the outside environment.

Fabric covered structures in one form or another have been around for thousands of years. Ancient fabric structures took many forms, from very primitive teepees to Arabic palaces. Today, most individuals are familiar with circus tents and tents used for camping.

However, the need for relatively inexpensive, portable, rapidly erected building structures has led to the development of framed tension structures able to handle forty pounds of snow per square foot, winds up to one hundred and twenty miles per hour, and having insulation, heating and cooling comparable to permanent building structures of wood, masonry, concrete or steel.

Framed tension structures which have heretofore been developed have fallen short of obtaining the full potential benefits to be derived from this type of construction. Prior designs have been overly complex and expensive and not well suited to a wide range of sizes.

SUMMARY OF THE INVENTION

It is therefore the primary object of the present invention to provide an improved framed tension structure.

It is another object of the present invention to provide an improved building-type structure of the type in which fabric or other web material is stretched over a load supporting frame.

Another object of the present invention is to provide such a structure in which the frame is covered with a plurality of individual rectangular sections of a flexible web material which are each adjustably tensioned across their width and length.

It is another object of the present invention to provide a framed tension structure in which individual fabric panels can be quickly and easily removed with minimum disturbance to the interior of the structure.

Another object of the present invention is to provide an improved framed tension structure in which the fabric tensioning means operates independently of, yet is carried by, a load supporting frame.

Another object of the present invention is to provide an improved framed tension structure which can be assembled on the ground in rapid fashion, and readily erected without cranes or other expensive heavy equipment.

Another object of the present invention is to provide a framed tension structure having inner and outer fabric skins to provide better thermal insulation.

Still another object of the present invention is to provide an improved framed tension structure which can be readily adapted for constructing structures in a wide range of sizes.

Still another object of the present invention is to provide an improved framed tension structure with a minimum amount of hardware and connectors.

Another object of the present invention is to provide an improved framed tension structure in which fabric or other web material sections are stretched along their planes in two directions by tensioning means supported by independent load carrying arch frames.

Still another object of the present invention is to provide an improved framed tension structure in which individual fabric or other web material panel sections can readily be stretched without scaffolding and by using a simple hand-operated tool.

Yet another object of the present invention is to provide an improved framed tension structure in which the tensioning mechanisms can be made of standard, uniform extruded ladder-like mechanisms.

Yet another object of the present invention is to provide an improved framed tension structure in which the fabric or other web material is stretched by adjustable mechanical means without requiring movement of the underlying load supporting frame.

Still another object of the present invention is to provide an improved framed tension structure in which variable load forces such as those imparted by high winds can be readily accommodated by articulating load supporting beams.

Yet another object of the present invention is to provide an improved framed tension structure in which the pitch can be increased to shed snow in colder environments or decreased in warmer climates to provide greater floor space or less susceptibility to high winds.

Still another object of the present invention is to provide an improved framed tension structure having novel fabric tensioning means adapted to be utilized with a wide variety of load supporting frames including beams, trusses, and other support configurations.

According to the present invention a portable, rapidly erected fabric covered building has a plurality of articulated arch frames which may be hoisted from the ground to extend transversely in longitudinally spaced vertical planes. Spreaders rigidly connect the arch frames. Individual rectangular fabric sections extend transversely between corresponding adjacent pairs of the arch frames to provide an interior sheltered from the outside environment. The side edges of the fabric sections are connected to the rails of removable ladder-like mechanisms carried by the frames for tensioning the sections across their widths. The ends of the fabric sections are also pulled downwardly at the sides of the building by other mechanisms for tensioning the fabric sections lengthwise.

DESCRIPTION OF THE PREFERRED EMBODIMENTS

Figure 1:
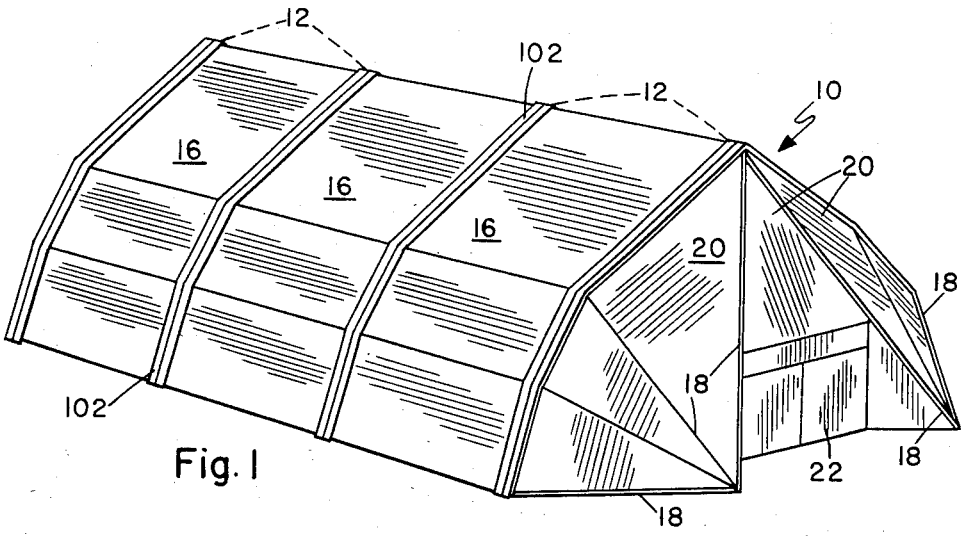
FIG. 1 is a perspective view of a preferred embodiment of my framed tension structure.
Figure 3:
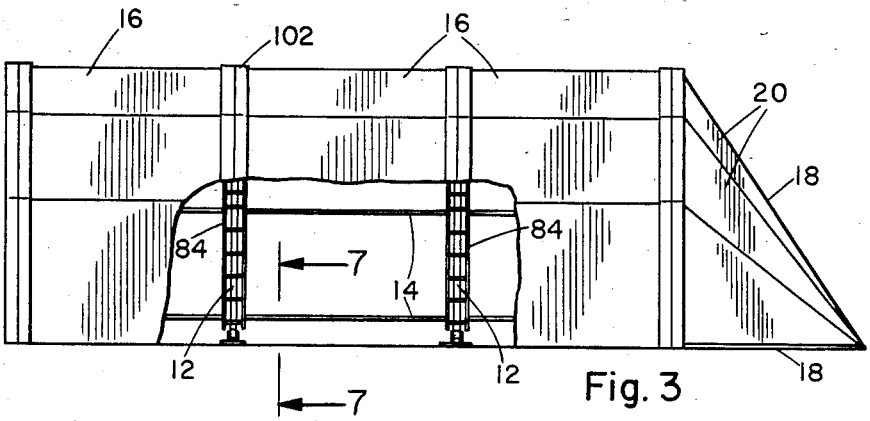
FIG. 3 is a side elevation view of the preferred embodiment of our framed tension structure with a portion of its fabric covering cut away.

Referring to FIGS. 1 and 3, the preferred embodiment 10 of our framed tension structure includes a plurality of longitudinally spaced arch frames 12 which extend transversely in vertical planes. The arch frames are visible in FIG. 3 but are covered by fabric flaps in FIG. 1 which are hereafter described. Accordingly, dashed lead lines for reference number 12 have been utilized in FIG. 1. A pluraliy of spreaders 14 (FIG. 3) extend longitudinally between and rigidly connect the arch frames 12. A plurality of rectangular sections 16 (FIGS. 1 and 3) of a flexible web material form the main covering of the structure. Each of these sections has a width corresponding to the longitudinal distance between adjacent ones of the frames 12 and a length corresponding to the transverse extension of the frames. In other words, each rectangular web section 16 extends from ground level on one side of the structure to ground level on the other side of the structure.

First means hereafter described are mounted on the arch frames 12 for adjustably tensioning each of the rectangular web sections 16 across its width between a corresponding adjacent pair of the arch frames. Second means hereafter described are also connected to the frames for adjustably tensioning each of the rectangular web sections 16 in the direction of its length.

The preferred embodiment of our framed tension structure illustrated in FIGS. 1 and 3 is provided with an end enclosure consisting of two sets of angularly spaced cables 18 which extend downwardly from an end arch frame 12. The cables 18 are covered by triangular sections 20 of a web material. A suitable door structure 22 is also provided. The other end of the preferred embodiment of our framed tension structure may be covered by vertically extending web sections (not illustrated) over suitable vertically extending cables (not illustrated) connected to the arch frame at the other end of the structure.

Figure 15:
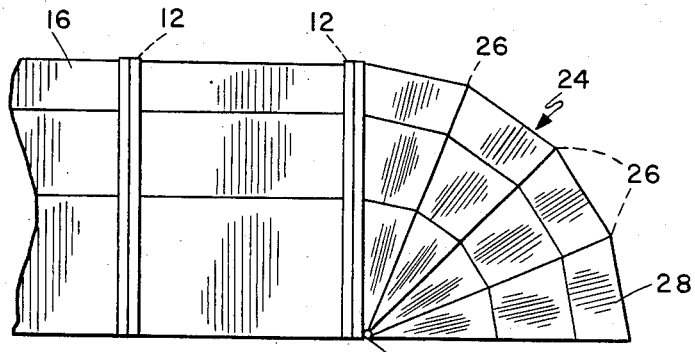
FIG. 15 is a side elevation view of a portion of a building constructed in accordance with our invention illustrating a accordion-type end closure.

A wide variety of end enclosures may be utilized with our invention. For example, FIG. 15 illustrates a accordion-type end enclosure 24. A second plurality of arch frames 26 are covered by fabric 28. The arch frames 26 are connected at their ends by respective joints 30 mounted to the corresponding ends of the arch frame 12 at the end of the structure. The arch frames 26 extend in planes angularly spaced between vertical and horizontal.

The web material of our preferred embodiment may be any fabric or other material. A wide variety of web materials which have heretofore been utilized in prior art tensioned frame structures may be utilized. Preferably, the rectangular web sections 16 are made of coated or laminate polyester vinyl chloride (PVC). By way of example, the laminate PVC may be rated at eighteen ounces per square foot while the coated PVC may be rated at twenty-two ounces per square foot. A structure using the coated PVC fabric will not admit as much light as a structure using the laminate PVC fabric. The difference in weave makes the coated PVC fabric opaque and the laminate PVC fabric translucent. The weave on the coated PVC fabric is tighter than the weave on the laminate PVC fabric. The coating on the coated PVC fabric adheres directly to the weave, whereas the coating of the laminate PVC fabric adheres to itself as well as to the weave. Factors to be considered in selecting a web material include estimated life expectancy, weight in ounces per square foot, tensile strength, strength of adhesion of the coating, tear strength, hydrostatic strength, blocking (scale rating 1, 2 or 3), cold crease, and flame resistance.

Figures 4, 5, 6:
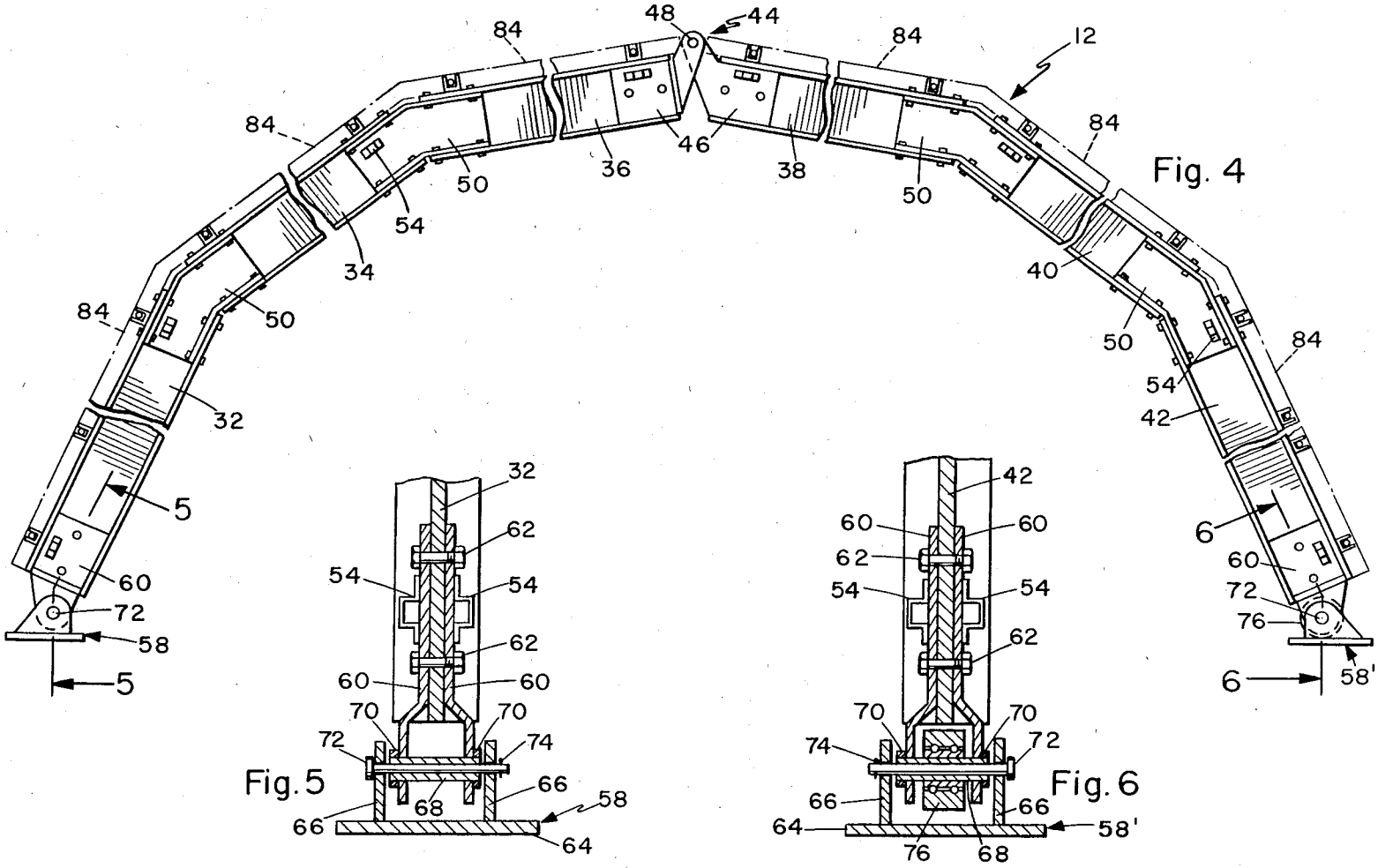
FIG. 4 is an enlarged side elevation view of a single articulated arch frame of the preferred embodiment of our invention with portions broken away and illustrating structural details of the same.
FIG. 5 is an enlarged sectional view of the pivoting end of the arch frame taken along line 5—5 of FIG. 4.
FIG. 6 is an enlarged sectional view of the rolling end of the arch frame pinned in position and taken along line 6—6 of FIG. 4.

FIG. 4 illustrates the construction of the arch frames 12 of the preferred embodiment of our frames tension structure. In general, the arch frame 12 is made of a plurality of straight segments 32, 34, 36, 38, 40 and 42 of steel I-beam. These I-beam segments are connected end to end and are angularly disposed relative to one another to form an arch. While the arch frames 12 of the preferred embodiment of our invention include I-beams, other load support memebers, for example trusses, may be utilized. The opposing ends of the I-beams 36 and 38 are connected for relative articulation by hinge means 44. This hinge means includes mating arm plates 46 bolted to opposite central sections of the I-beams 36 and 38 and pivotally connected by a pin 48. The arm plates 46 extend far enough past the ends of the I-beam segments to permit the arch frame to articulate between a collapsed position illustrated in phantom lines in FIG. 2 and a raised position illustrated in solid lines in FIG. 2.

The other I-beam segments besides 36 and 38 are connected end to end by rigid angular joint means. Specifically, referring to FIGS. 10 and 11, angular moment plates 50 having a channel-shaped cross section are formed with angularly disposed segments. These moment plate segments are conformably received in opposite sides of the adjacent ends of a pair of I-beams such as 34 and 36. Preferably one set of ends of the opposing pair of moment plates is secured to one I-beam semi-permanently with nut and bolt combinations. The other ends of the moment plates may then be secured to the adjacent I-beam with removable pin assemblies 52. In this fashion, when the structure is transported, it may be quickly erected merely by attaching the moment plates on one end of an I-beam segment to a corresponding I-beam segment with the removable pin assemblies, thus reducing erection assembly time.

Figure 9:
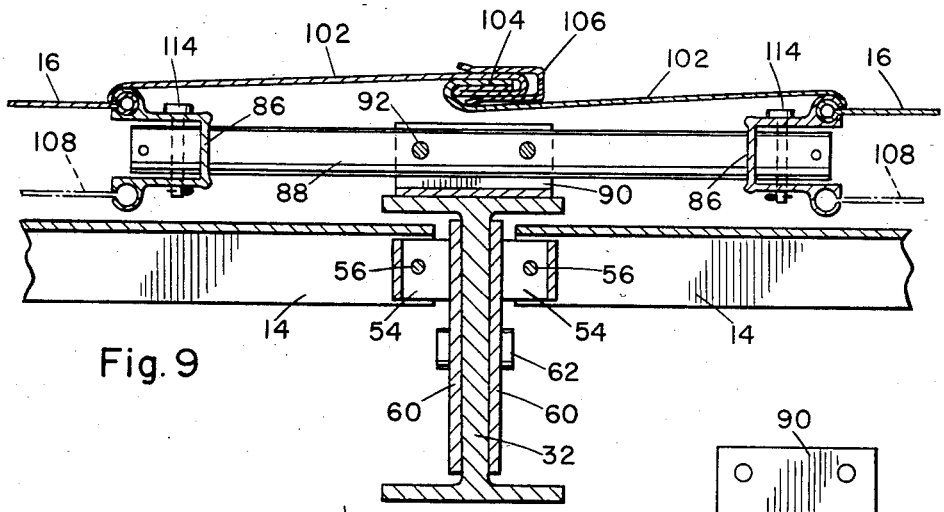
FIG. 9 is an enlarged sectional view taken along line 9—9 of FIG. 8 and illustrating further details of the ladder-like mechanism used to tension the fabric sections across their width and also illustrating the fabric flaps which overlap and cover the ladder-like mechanisms.
Figure 10:
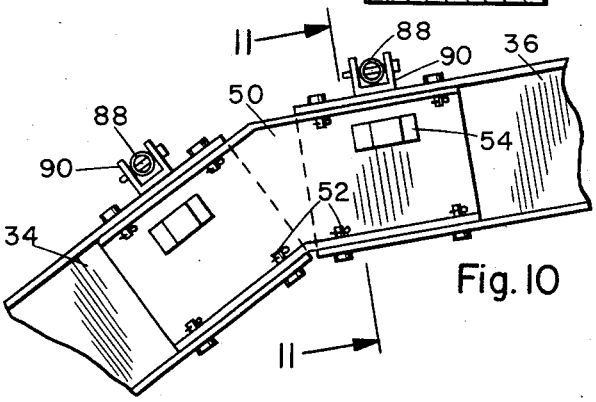
FIG. 10 is an enlarged view of a portion of the arch frame of FIG. 4 illustrating a fixed angular connection of two segments of the frame.
Figure 11:
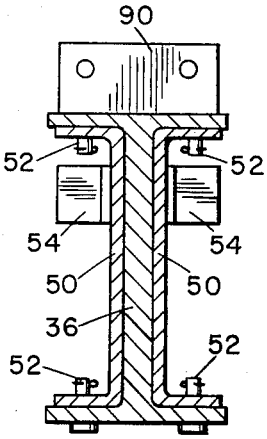
FIG. 11 is an enlarged verical sectional view taken along line 11—11 of FIG 10 illustrating the I-beam construction of the arch frame.

Also visible in FIGS. 10 and 11 are spreader connection brackets 54 which are welded to opposite halves of each of the moment plates 50 on the exposed sides thereof. As illustrated in FIG. 9, the ends of the channel-shaped spreaders 14 fit over corresponding spreader brackets 54 and are secured thereto by releasably pin assemblies 56.

Referring to FIGS. 4 and 5, the ends of the arch frames 12 are connected to anchors 58 and 58'. A pair of hinge plates 60 (FIG. 5) are attached to opposite sides of the I-beam segment 32 by bolts 62. The hinge plates 60 are bent outwardly at the remote end of the I-beam segment 32. Brackets 54 are welded to each of the hinge plates for connection to the corresponding spreaders 14.

The anchor 58 (FIG. 5) includes a base plate 64, which may be rigidly secured to a foundation (not illustrated) such as the ground, concrete slab or some other suitable structure. The anchor 58 further includes trunnions 66 which are welded to the base plate 64 and extend vertically therefrom at spaced-apart locations. A cylindrical sleeve 68 extends through the remote ends of the hinge plates 60 between the trunnions 66. The ends of the sleeve 68 are threaded and nuts 70 are screwed over the same to hold the sleeve to the hinge plates. A removable pin 72 extends through the holes in the trunnions 66 and through the center of the sleeve 68 and is held in position by a cotter pin 74.

Referring to FIG. 6, the other end of each of the arch frames 12 has similar structure as indicated by the like reference numerals. In addition, a ball-bearing wheel 76 is journaled about the sleeve 68 between the remote ends of the hinge plates 60.

Figure 2:
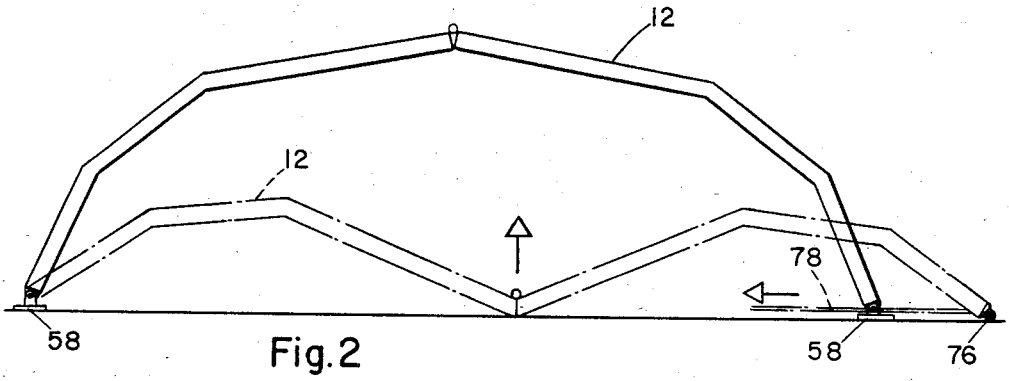
FIG. 2 is a simplified side elevation view of two positions of one of the articulated arch frames of the preferred embodiment illustrating a first method of erection.

When the prefered embodiment of our framed-tension structure is erected, each of the arch frames 12 is initially assembled in the general configuration illustrated in phantom lines in FIG. 2. The end of the arch frame having the I-beam segment 32 is pinned to the anchor 58 on the left side of FIG. 2. The other end of the arch frame is positioned with its ball-bearing wheel 76 engaged with the foundation outboard of the other anchor 58' on the right side of FIG. 2. A cable 78 is connected to the I-beam segment 42 and is gradually pulled horizontally across the foundation by a winch (not illustrated). This causes the ball-bearing wheel 76 to roll inwardly along the foundation toward the anchor 58'. This rolling action causes the arch frame to assume the raised configuration illustrated in solid lines in FIG. 2. As the arch beam approaches this raised configuration, the wheel 76 rolls between the trunnions 66 of the anchor 58'. The pin 72 is inserted through the anchor 58' and through the wheel 76. This hold the arch frame in its raised configuration. The same winch assembly may then be moved to pull next arch frame into its raised position.

Figure 12:
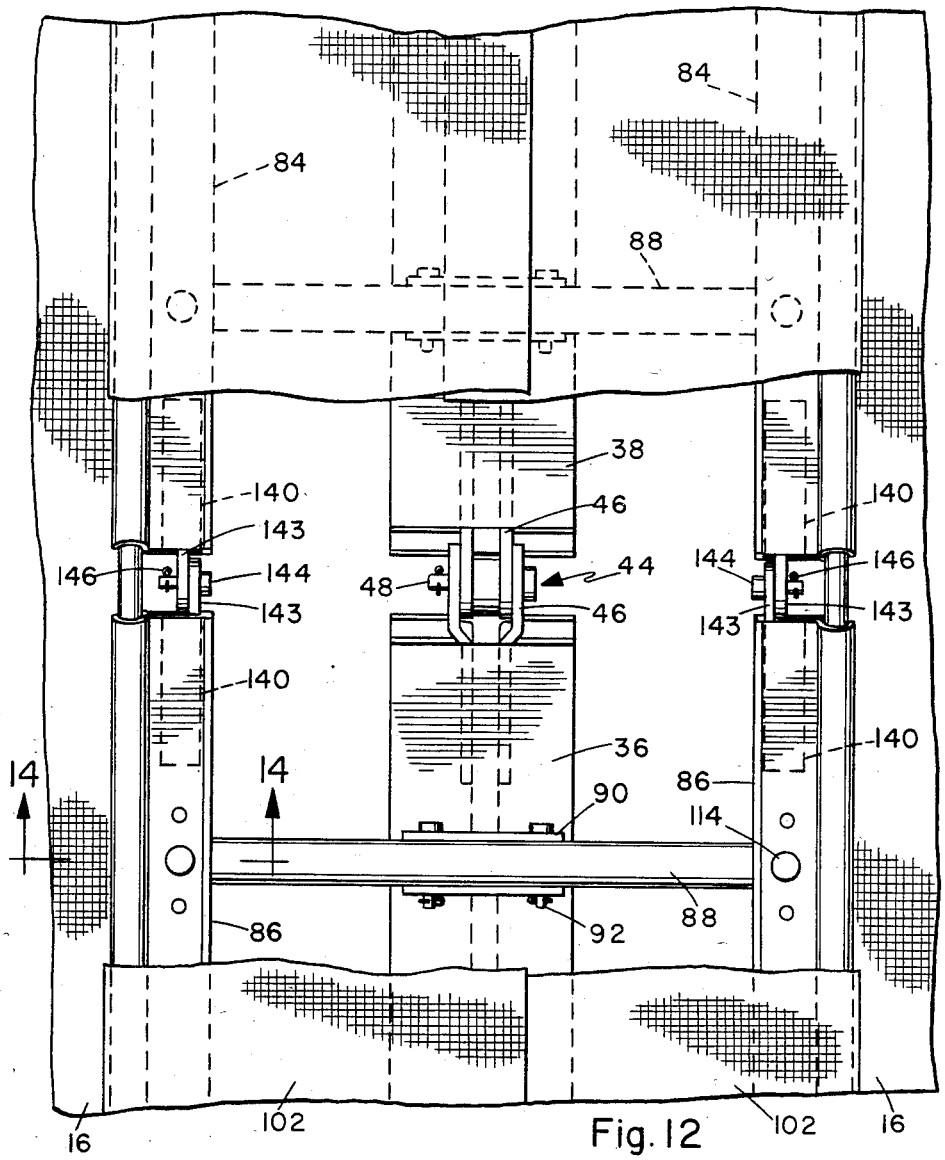
FIG. 12 is a top plan view of a central hinged joint of one of the arch frames of the preferred embodiment illustrating the attached fabric securing ladder-like mechanism.
Figure 17:
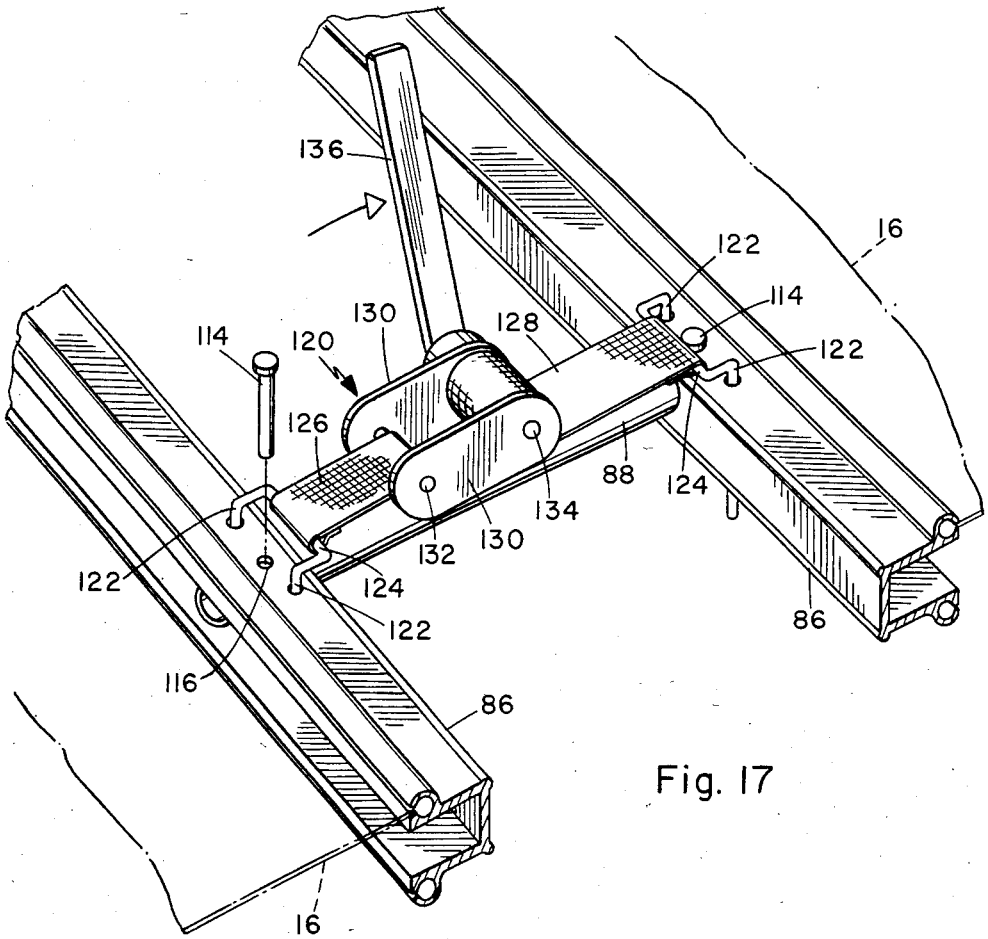
FIG. 17 illustrates the manner in which fabric sections of the preferred embodiment of our invention can be tensioned or stretched tight across their widths by pulling the rails on a ladder-like mechanism closer together with a winch mechanism so that the rails can be pinned into a position where the fabric is tight.
Figure 18:
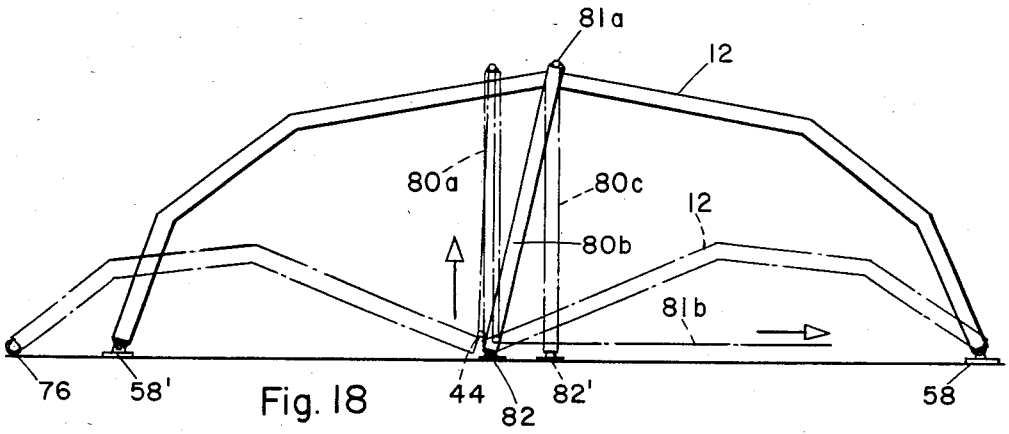
FIG. 18 is a simplified side elevation view of two positions of an articulated arch frame of our invention illustrating an alternate method of erection utilizing a vertical mast to hoist the center of the frame into position.

FIG. 18 illustrates an alternate method of erecting each of the arch frames 12 of our preferred embodiment. Specifically, a vertical mast 80 is used which is illustrated in three different positions in FIG. 18, namely **80*a*, 80*b* and 80*c*. The mast has a pulley 81*a* rotatably mounted to its upper end. And a cable 81*b* feeds over the pulley 81*a* and is used to raise the center of the arch frame. The mast is initially erected in the position illustrated in phantom lines at 80*a* in FIG. 18. The lower end of the mast is pivotally mounted to a sliding anchor 82. One end of the cable 81*b* is attached to the hinge means 44 at the center of the arch frame. The end of the arch frame without the wheel 76 is pivotally connected to the anchor 58. A winch or other mechanism is then used to draw in the other end of the cable. This causes the arch frame 12 to move from its collapsed configuration illustrated in phantom lines in FIG. 18 to its raised configuration illustrated in solid lines in FIG. 18. The other end of the arch frame having the wheel 76 rolls in along the foundation and is secured to the other anchor 58' when the arch frame reaches its raised position. At this point, the mast will be in its inclined position illustrated at 80*b* in FIG. 18. The sliding anchor 82 is then moved to the position illustrated at 82' so that the mast is in a vertical position illustrated in phantom lines at 80*c* in FIG. 18. The mast may then form a part of the structure and help support the roof load. Alternatively, the mast may be removed and used to erect the next arch frame. As illustrated in FIGS. 3 and 12, a plurality of ladders 84 are carried on top of each of the arch frames 12. Each ladder-like mechanism includes a pair of parallel rails 86 (FIGS 8 and 17) and a plurality of rungs 88 which extend perpendicularly between and connect the rails. As illustrated in FIG. 9, each of the rails extends parallel to and is spaced on either side of the arch frame to which the ladder-like mechanism is mounted. The intermediate portion of each of the rungs is received in and carried by an upwardly opening channel section 90 (FIG. 8) welded to the top of the corresponding I-beam segment of the arch frame. Bolts 92** extend through the sides of each of the channel sections and through the nested rung to hold the ladder-like mechanism rigidly in position on the arch frame.

Figure 14:
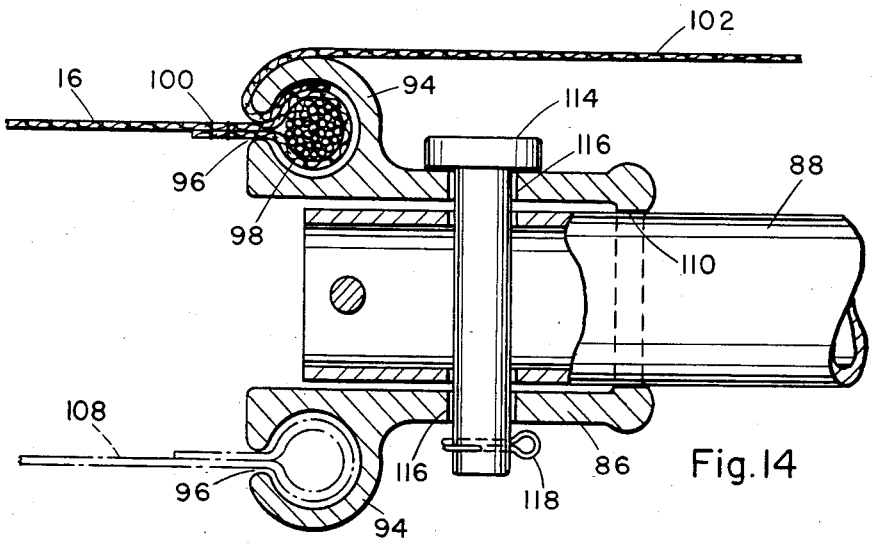
FIG. 14 is a greatly enlarged sectional view of one of the side rails and cross rungs of the ladder-like structure taken along line 14—14 of FIG. 12 and illustrating the manner in which the fabric sections and the flaps are retained in the rail.

Referring to FIG. 14, each rail 86 is preferably made of extruded aluminum and has a generally U-shaped cross section. A pair of tubular receptacles 94 extend along the edges of each rail. Each receptacle has an outwardly facing slit opening 96 along its entire length.

The side edges of each of the rectangular fabric sections 16 (FIGS. 1 and 14) are folded around NYLON rope 98. The overlapping portions of the fabric are stitched or otherwise secured together at 100.

Rectangular flaps 102 (FIG. 9) are provided for covering the openings that would otherwise exist between the rails of each of the ladder structures. As illustrated in FIG. 14, the outer side edge of each flap 102 is preferably heat welded or otherwise affixed to the portion of a corresponding fabric section 16 which surrounds the rope 98. Each flap has a length corresponding to the sum of the lengths of the I-beam segments making up the arch frames. During assembly of our framed tension structure, the side edges of a fabric section 16 and a flap 102, which are connected, are fed through the upper receptacle 94 of the corresponding ladder rail 86. The width of each of the flaps 102 is sufficient so that the unattached inner side edges of the flaps mounted to the rails of the same ladder may be rolled over into a standing seam 104 (FIG. 9). This seam is held together by removable clasps 106 or rope ties (not shown).

Rectangular fabric sections 108 corresponding in length and width to the fabric sections 16 also have their rope surrounding side edges fed through the lower receptacle 94 of a corresponding rail 86. The fabric sections 108 thus provide the frame of the building with a second fabric covering. Each of the fabric sections 16 extends parallel to and is spaced from the plane of the corresponding fabric section 108 lying immediately below. The fabric sections 108 may be made of the same material as the fabric sections 16. The air space between fabic sections improves the thermal insulation of the building structure.

As illustrated in FIG. 14, the rails 86 of each of the ladder-like mechanisms have holes 110 through which corresponding rungs 88 extend. Each rung is provided with a plurality of longitudinally spaced holes 112 (FIG. 8) at each end thereof. The rails of each ladder-like mechanism may be moved toward and away from each other by sliding along the rungs 88 which connect the same. Pins 114 (FIG. 17) may be slid through holes 116 in the rails 86 and through selected ones of the holes 110 in the rungs 88 to fix the spacing between the rails of a ladder-like mechanism. The pins 114 may be removably held in position by cotter pins 118 which may be inserted in transversely extending holes in the forward end of the pins.

Referring to FIG. 17, a winch mechanism 120 may be used to pull the rails 86 of a ladder-like mechanism together to stretch the attached fabric sections 16 across their widths throughout the entire length of the ladder-like mechanism. A pair of holes 122 extend through each rail on either side of each connected rung 88. The legs of a pair of U-shaped retaining members 124 are inserted in the holes 122 in the rails. One strap 126 of the winch mechanism has one end permanently connected to the intermediate portion of one of the retaining members 124. Another strap 128 has one end permanently connected to the intermediate portion of the other retaining member. The winch mechanism includes a frame made up of parallel side pieces 130 connected by transversely extending posts 132 and 134. The other end of the strap 126 is permanently attached to the post 132. The other end of the other strap 128 is wound about a spool (not visible). This spool may be rotated about the post 134 by movement of the lever 136 in the direction indicated by the arrow in FIG. 17. A ratchet mechanism of conventional design is interconnected between the lever 136 and the spool to permit the rails 86 to be gradually pulled together by repeated back-and-forth movement of the lever 136 without slippage.

When the preferred embodiment of our framed tension structure is erected, a worker can climb the ladder-like mechanisms and use the winch mechanism 120 as he reaches each rung. Each time the worker inserts the U-shaped retaining members 124 into the rails, inserts a first pin 114 to fix the position of one of the rails, then moves the lever 136 to pull the other rail toward it. When sufficient tension has been achieved on the fabric section 16 attached to the moving rail, the second pin 114 is inserted. The other fabric section 16 is then stretched by removing the first pin 114, cranking a lever 136 to pull the other rail in the required distance, and then reinserting the first pin 114. The worker then removes the U-shaped retaining members 124 and reuses the winch mechanism 120 over the next rung of the ladder-like mechanism. All of the ladder-like mechanisms are similarly adjusted to tighten each fabric section 16 widthwise over its entire length.

Figure 13:
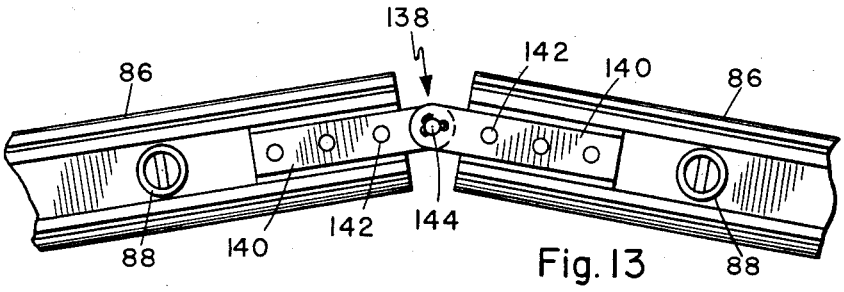
FIG. 13 is a side elevation view of one of the hinged joints of the ladder-like structure illustrated in FIG. 12.

As illustrated in FIG. 4, the length of each of the ladder-like mechanisms 84 is equal to the length of the I-beam segment to which it is attached. The adjacent ends of the ladder-like mechanisms are cut or mitered so that when abutted they form the same angle as the underlying abutting I-beam segments. Where the underlying I-beam segments are rigidly secured together, such as the I-beam segments 34 and 36 (FIG. 10), the abutting ends of the ladder-like mechanism carried thereby are rigidly secured together. The abutting rails of the two ladder-like mechanisms carried by the I-beam segments 36 and 38 (FIG. 4) are connected by hinge means 138 (FIG. 13). This hinge means includes channel members 140 (FIGS. 12 and 13) secured by bolts 142 to the adjacent rail ends. The members 140 have ears 143 which overlap each other and are pivotally connected by removable pins 144. These pins 144 are held in position by removable cotter pins 146 (FIG. 12). Hinge means 44 and 138 pivot together as the arch frame is raised.

Figure 7:
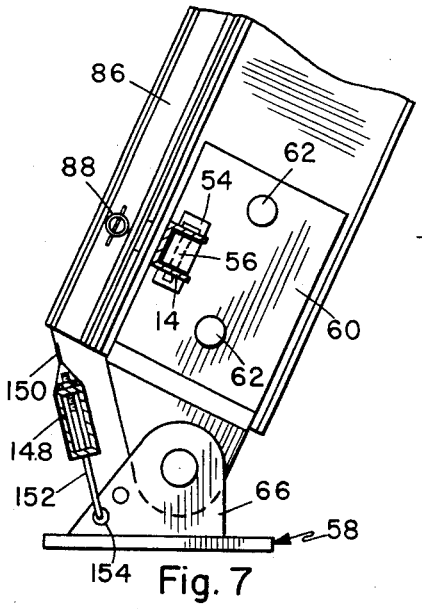
FIG. 7 is a greatly enlarged side elevation view taken along line 7—7 of FIG. 3 and illustrating the mechanism used to tension a fabric section in the direction of its length.
Figure 8:
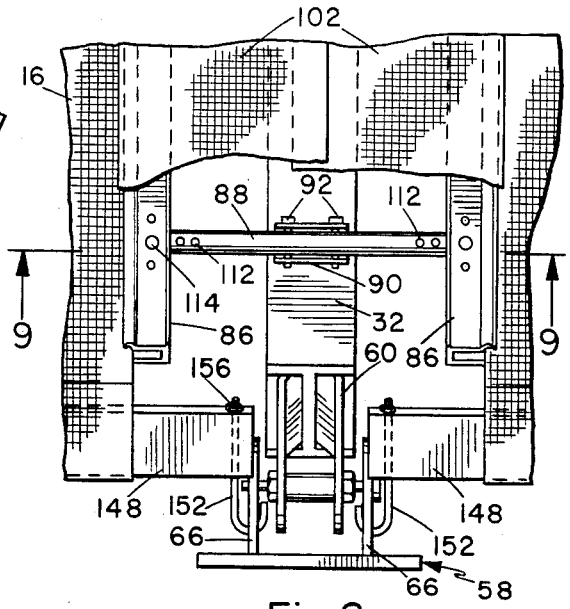
FIG. 8 is an elevation view taken from the left-hand side of FIG. 7 illustrating the mechanisms of our invention which are utilized to tension fabric sections across their widths and along their lengths.

Each of the fabric sections 16 is tensioned along its entire length. As illustrated in FIGS. 7 and 8, the ends of each fabric section 16 near the foundation are wrapped around a floating box beam 148 and stitched or otherwise secured at 150. The ends of the box beam 148 fit over the threaded legs of hook elements 152. The curved portion of each of the hooked elements are received in holes 154 in the trunnions 66 of the anchors 58 or 58'. Nuts 156 (FIG. 8) are screwed over the threaded leg of each of the hook elements 152 and may be tightened to force the floating box beam 148 downwardly. Thus, when each end of a fabric section 16 is connected to a floating box beam in this manner, tightening of the nuts 156 will stretch and tension the fabric section over its entire length.

The ends of the underlying fabric sections 108 may be wrappped around the same floating box beams as the overlying fabric sections 16. Thus, when the nuts 156 are tightened and a box beam moved downwardly, both the upper fabric section 16 and the underlying fabric section 108 will be stretched along its entire length. Alternatively, a second independent means for longitudinally stretching the underlying fabric sections 108 may be provided.

Figure 16:
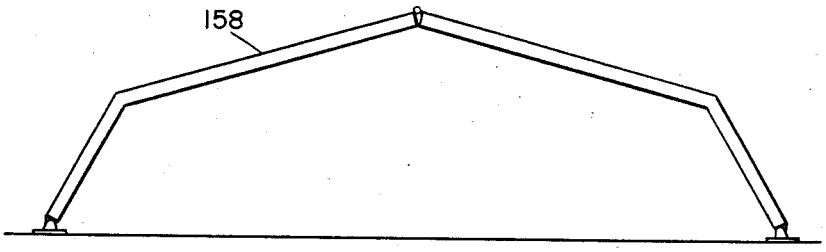
FIG. 16 illustrates an alternate, simplified construction of an arch frame that may be used in our invention.

Having described preferred embodiments of our framed tension structure, it will be apparent to those skilled in the art that our invention permits of modification in both arrangement and detail. For example, articulated arch frames 158 (FIG. 16) may be utilized which have only four angled segments. The longitudinal and lateral fabric tensioning mechanisms of our invention can be incorporated into a wide variety of other frame structures. Therefore, the protection afforded our invention should only be limited in accordance with the scope of the following claims.

We claim:

1. A building structure comprising:

a plurality of longitudinally spaced arch frames extending transversely in generally vertical planes;

a plurality of spreaders extending longitudinally between and rigidly connecting the frames;

a plurality of rectangular sections of a flexible web material, each web section having a width corresponding to the longitudinal distance between adjacent ones of the frames and a length corresponding to the traverse extension of the frames;

first means mounted on the frames for adjustably tensioning each web section across its width between a corresponding adjacent pair of frames; the first tensioning means includes:

a plurality of ladder-like mechanisms each having a pair of parallel rails, a plurality of rungs connecting the rails;

means for adjusting the spacing between the rails;

means for attaching the rungs of each ladder-like mechanism to a corresponding frame so that the rails extend transversely; and means on each rail for retaining a lengthwise edge of a corresponding web section; and second means connected to the frames for adjustably tensioning each web section in the direction of its length.

2. A building structure according to claim 1 and further comprising a plurality of pairs of rectangular flaps made of a flexible web material, one flap of each pair having one lengthwise edge connected to one rail of each pair of rails and the other flap of the pair of flaps having one lengthwise edge connected to the other rail of the pair of rails, the flaps of each pair overlapping each other along the portion thereof adjacent their other lengthwise edges.

3. A building structure comprising:

a plurality of longitudinally spaced arch frames extending transversely in generally vertical planes;

a plurality of spreaders extending longitudinally between and rigidly connecting the frames;

a first plurality of rectangular sections of a flexible web material, each web section having a width corresponding to the longitudinal distance between adjacent ones of the frames and a length corresponding to the traverse extension of the frames;

a second plurality of rectangular sections of a flexible web section having a width corresponding to the longitudinal distance between adjacent ones of the frames and a length corresponding to the transverse extension of the frames; and adjustable width tensioning means mounted on the frames for simultaneously adjustably tensioning each first and second web section across its width between a corresponding adjacent pair of frames so that each second web section is parallel to and spaced from the plane of a corresponding first web section tensioned between the same frame; said adjustable width tensioning means includes:

a plurality of ladder-like mechanisms each having a pair of parallel rails;

a plurality of rungs connecting the rails;

means for adjusting the spacing between the rails;

means for attaching the rungs of each ladder-like mechanism to a corresponding frame so that the rails extend transversely; and means on each rail for retaining the corresponding lengthwise edges of corresponding first and second web sections.

4. A building structure according to claim 3 further comprising:

adjustable length tensioning means connecting to the frames for simultaneously adjustably tensioning the corresponding first and second web sections in the direction of their length.

* * * * *